United States Patent [19]

Carlin et al.

[11] 4,174,269

[45] Nov. 13, 1979

[54] METHOD OF TREATING ELECTRODES

[75] Inventors: William W. Carlin, Portland; Lois A. Dahlberg, Corpus Christi, both of Tex.

[73] Assignee: PPG Industries, Inc., Pittsburgh, Pa.

[21] Appl. No.: 917,621

[22] Filed: Jun. 21, 1978

[51] Int. Cl.[2] ..... C25F 1/06

[52] U.S. Cl. ..... 204/129.95; 204/129.75; 204/145 R

[58] Field of Search ..... 204/145 R, 129.75, 129.95; 252/142, 146, 147; 134/3, 41

[56] References Cited

U.S. PATENT DOCUMENTS

| | | | |
|---|---|---|---|
| 2,481,306 | 9/1949 | Gall et al. | 204/129.75 |
| 2,714,094 | 7/1955 | McNally | 252/142 X |
| 2,993,862 | 7/1961 | Monroe et al. | 252/146 |
| 3,242,062 | 3/1966 | Covington | 204/129.95 |
| 3,282,850 | 11/1966 | Davidowich et al. | 204/145 R |
| 3,708,014 | 1/1973 | Wally | 134/3 X |
| 3,773,465 | 11/1973 | Keeney et al. | 252/147 X |
| 3,936,316 | 2/1976 | Gulla | 134/3 |
| 4,010,086 | 3/1977 | Barrett et al. | 204/141.5 |

*Primary Examiner*—F. C. Edmundson
*Attorney, Agent, or Firm*—Richard M. Goldman

[57] ABSTRACT

Disclosed is a method of cleaning foraminous metal bodies, for example, cathodes, of corrosion products and asbestos. The method is carried out by contacting the body with an aqueous cleaning solution containing an oxidation inhibitor, hydrochloric acid, and a source of hydrofluoric acid. Also disclosed is a method of electrolytically treating the cleaned metal surface with an organic hydroxy phosphonic acid.

6 Claims, No Drawings

METHOD OF TREATING ELECTRODES

DESCRIPTION OF THE INVENTION

Chlorine and alkali metal hydroxide are commercially produced by the electrolysis of aqueous alkali metal chloride, i.e., alkali metal chloride brine, in an electrolytic cell. One type of electrolytic cell useful for carrying out the electrolysis of alkali metal chloride brines is a cell having an anolyte compartment separated from a catholyte compartment by a separator. The brine is fed to the anolyte compartment, chlorine is evolved at the anode, and the alkali metal ions traverse the separator to the catholyte compartment. In the catholyte compartment alkali metal hydroxide and hydrogen are formed.

The separator may be a diaphragm that is porous to alkali metal chloride such as an asbestos diaphragm, a reinforced asbestos diaphragm, or a microporous diaphragm. Alternatively, the separator may be a permionic membrane, i.e., a cation selective permionic membrane that is substantially impermeable to the flow of anions and permeable to the flow of cations.

Electrolyte permeable separators, e.g., diaphragms, may be fabricated of asbestos. The asbestos may be deposited from a slurry of asbestos in alkali metal hydroxide and alkali metal chloride to form an asbestos deposit on the cathode. Alternatively, the asbestos may be deposited from a slurry of asbestos and polymeric resin whereby to form a resin-reinforced diaphragm. According to a further technique, the asbestos may be deposited from a slurry and thereafter treated with a polymeric material to form a resin-reinforced asbestos.

The polymeric resin is preferably a thermoplasitc resin. It may by a hydrocarbon resin, a halocarbon resin, or a copolymer having halocarbon and hydrocarbon moieties. Typical resins include copolymers of ethylene and chlorotrifluoroethylene, ethylene and vinyl fluoride, ethylene and vinylidene fluoride, homopolymers of chlorotrifluoroethylene, vinyl fluoride, vinylidene fluoride, tetrafluoroethylene, as well as various fluorocarbon polymers such as copolymers of tetrafluoroethylene with hexafluoropropylene or with perfluoroalkoxy. Particularly desirable resins include the alternating copolymer of chlorotrifluoroethylene and ethylene. The resin may also have pendant acid groups, as carboxylic groups, sulfonic groups, phosphonic groups, or reaction products thereof.

Resin-reinforced asbestos diaphragms deteriorate with age and must be removed from the cathode. Removal of the resin-reinforced asbestos diaphragm has typically been carried out either hydraulically, that is, by the use of high pressure water hoses, or mechanically, that is, by abrasion. However, such abrasive or hydraulic means are not altogether satisfactory in electrolytic cells having cathodes in the form of parallel fingers extending outwardly from a common base and spaced from one another on a narrow center line-to-center line distance.

It is necessary to find a method for dissolving the asbestos diaphragms, especially resin-reinforced asbestos diaphragms, from the surface of the cathode while allowing the cathodes to be re-used. Additionally, the cathodes have oxidation products thereon, including various oxides of iron and of the alloying elements present therein, e.g., rust. In the case of cathodes that are to be recoated, for example, with cathode depolarization catalysts or hydrogen evolution catalysts, it is necessary to remove these corrosion products and oxidation products prior to recoating the cathodes.

According to the method herein disclosed, it is possible to remove asbestos, including resin-reinforced asbestos, from foraminous cathode fingers, especially iron and steel cathode fingers, without rendering the cathode unusable. It is also possible, according to the method herein disclosed, to remove oxidation products and corrosion products from the cathodes prior to recoating without rendering the cathodes unusable. It is also possible, according to the method disclosed herein, to remove asbestos diaphragms, including resin-reinforced asbestos diaphragms and corrosion products, without rendering the diaphragm unusable, in a single solution.

DETAILED DESCRIPTION OF THE INVENTION

Disclosed herein is a single solution for removal of asbestos, including resin-reinforced asbestos and iron and steel corrosion products, from a foraminous or perforate iron-containing metal member, e.g., a cathode, with a single solution. Most frequently, the metal cathode is fabricated of iron or alloys of iron such as steel. When iron is referred to herein, it is to be understood that iron alloys are also contemplated. Alternatively, the cathodic metal body may be a metal such as nickel. When an iron-containing metal body is referred to, it is to be understood to mean metal bodies fabricated of iron and of iron alloys such as alloys with cobalt, nickel, chromium, manganese, carbon, and including steel and stainless steel. The solution is substantially nondestructive with respect to the cathode materials of construction. The single solution is an aqueous solution containing a source of hydrofluoric acid, hydrochloric acid, and an iron corrosion inhibitor.

The source of hydrofluoric acid may be aqueous hydrofluoric acid, a fluorine salt capable of ionization in the presence of hydrochloric acid, or a mixed hydrofluoric acid salt capable of dissolution in the presence of hydrochloric acid. Preferably, the source of hydrofluoric acid is a solid material that may be more safely utilized by workmen. One material that is solid at room temperatures is ammonium bifluoride, $NH_4.HF$, which is a solid powder soluble in water without fuming. In this way, the handling of liquid hydrofluoric acid is eliminated.

The hydrochloric acid may be added to the solution as anhydrous hydrochloric acid or as aqueous hydrochloric acid. The aqueous hydrochloric acid has a normality of from about 0.01 normal to about 10 normal and preferably from about 4 to 6 normal.

The iron corrosion inhibitor is a polar organic material. Satisfactory polar organic materials include acids, alcohols, hydroxy acids, and phosphonic acid and amine type iron corrosion inhibitors.

The composition of the solution is typically from about 0.5 to about 5 weight percent hydrofluoric acid calculated as total HF, basis total weight of the solution, and preferably from about 0.8 to about 3.5 weight percent hydrofluoric acid calculated as total HF, basis weight of the solution. In the case of ammonium bifluoride with a ratio of HF to $NH_4.HF$ of 0.54, the solution contains from about 2.5 to about 10 weight percent ammonium bifluoride.

The hydrochloric acid content, calculated as anhydrous hydrochloric acid, basis total weight of the solution, is from about 5 to about 15 weight percent hydrochloric acid and preferably from about 6 to about 12 weight percent hydrochloric acid.

The ratio of hydrochloric acid to hydrofluoric acid is less than 2.5 and preferably from about 0.75 to about 1.50. Higher ratios of hydrochloric acid to hydrofluoric acid are more corrosive to the cathode materials of construction, especially iron.

The iron corrosion inhibitor, described above, is present in an amount of from 0.01 to about 0.1 weight percent, basis total weight of the solution. Preferably, the weight of the iron corrosion inhibitor is high enough to provide a corrosion rate of less than 0.5 and preferably less than 0.1 micron per hour, determined either by weight loss or thickness measurement.

The amount of the solution required to remove the asbestos diaphragm is on the order of 110 to 200 liters of solution per kilogram of asbestos.

The method of this invention is carried out by inserting the asbestos-bearing cathode element in the cleaning solution. The time in the cleaning solution is a function of the thickness of the diphragm and has been found to be from about 1 to about 12 hours for removal of a diaphragm having a weight of about 0.3 pounds of asbestos per square foot of cathode area (0.16 grams of asbestos per square centimeter of diaphragm area) and containing about 5 to 15 weight percent of thermoplastic halocarbon resin that has not been previously partially removed by hydraulic pressure or abrasion. However, shorther periods of time, for example, from about 1 to about 6 hours, may be utilized where substantial portions of the diaphragm have first been removed by high pressure water or abrasion.

Where the diaphragm or membrane is a separately removable sheet or film and the purpose of the treatment is to remove corrosion products, the treatment time is on the order of about 1 minute to 30 minutes, although shorter removal times may be utilized if the ratio of hydrochloric acid to available hydrofluoric acid is above 2.5 or below 0.75. Longer times, for example, in excess of 30 minutes and even up to one hour, may be necessary where the ratio of hydrochloric acid to hydrogen fluoride is on the order of about 1. Preferably, the time of immersion is from about 5 minutes to about 15 minutes at temperatures of from about 20° C. to about 40° C. Longer times may be necessary at lower temperatures and shorter times at higher temperatures.

The temperature of the solution may be between the freezing point and the boiling point thereof. Preferably, the temperature is from about 20° C. to about 40° C. This is hot enough to provide satisfactory kinetics of corrosion product removal and asbestos removal but cold enough to avoid substantial fume formation.

According to a further exemplification of this invention, the clean cathode may be prepared to receive a surface coating, e.g., of an electrocatalytic material. This is accomplished by anodizing the clean metal substrate in an aqueous solution of a hydroxy acid. The clean metal may be iron, including alloys of iron as defined hereinabove, nickel, copper, or any metal chemically resistant to concentrated alkali metal hydroxides.

The hydroxy acids useful in the treatment of the cathode include $\alpha$-hydroxy acids, $\beta$-hydroxy acids, $\Gamma$-hydroxy acids, and acids with even greater separation between the hydroxy groups and the acids groups. There may be one acid group per molecule, as glycolic acid and lactic acid. Alternatively, the hydroxy acids may contain more than one acid group.

The acid groups may be carboxylic acid groups, phosphonic acid groups, or sulfonic acid groups. One particularly desirable hydroxy acid is 1-hydroxy ethane-1,1-diphosphonic acid.

The aqueous treating solution contains about 0.1 to about 1.0 mole of the hydroxy acid per liter and preferably about 0.15 to about 0.5 mole of the hydroxy acid per liter.

A clean metal surface, for example, after cleaning in the hydrogen fluoride-hydrochloric acid-iron corrosion inhibitor cleaning solution, is inserted in the aqueous hydroxy acid treating solution and rendered anodic at a current density of from about 5 to about 20 amperes per square foot, i.e., about 5.5 to about 22 amperes per square decimeter. Electrolytic treatment is continued until the electrode potential versus a reference electrode has increased at least 0.01 volt and preferably 0.02 volt versus a silver-silver chloride reference electrode when measured at constant current density. This potential decrease is believed to occur upon the substantially complete desorption of hydrogen from the metal. Generally, the time required for the electrode potential to increase by 0.01 to 0.02 volt is on the order of 3 to 15 minutes, although longer periods of treatment may be utilized.

According to a further exemplification, the cleaned iron-containing metal body is first rendered cathodic for at least about 5 minutes in order to remove residual corrosion inhibitor as well as any oxides that have formed since removal from the hydrogen fluoride-hydrochloric acid-corrosion inhibitor cleaning bath. After the cleaned metal has been rendered cathodic for at least about 5 minutes, it is rendered anodic until the electrode potential against a silver-silver chloride reference electrode has increased at least 0.01 to 0.02 volt. Thereafter, the electrode is rinsed in water and a coating, e.g., an electrocatalytic coating, is applied.

According to one exemplification of this invention, a resin-reinforced asbestos diaphragm is removed from a cathode element having twenty-four individual cathode fingers 18 inches (45.7 cm) long by 36 inches (91.4 cm) high on a three inch (7.6 cm) center line-to-center line pitch, with facing cathode surfaces two inches (5 cm) apart. The cathode had a diaphragm of resin-reinforced chrysotile asbestos codeposited from a slurry of chrysotile and 10 percent Allied Chemical Company HALAR® alternating poly(chlorotrifluoroethylene-ethylene), basis weight of total asbestos and resin. Thereafter, the cathode element, with the deposited diaphragm thereon, was heated above the melting point of the resin to cause the resin to melt and flow, forming a resin-reinforced asbestos diaphragm. After approximately 13 months of electrolysis, the cathode unit is removed from service. The cathode, having the resin-treated asbestos diaphragm still intact thereon, is inserted in an aqueous solution containing 5 weight percent hydrochloric acid, 3.5 weight percent ammonium bifluoride, basis total weight of the solution, and 0.1 weight percent Amchem Corporation Rodine 213 amine iron corrosion inhibitor. The cathode element is soaked in the cleaning solution for approximately 6 hours at a temperature of approximately 27° C. Thereafter, the cathode unit is removed from the solution and the resin-treated asbestos diaphragm disintegrates to the touch. The cathode fingers are substantially free of rust, oxidation products, and corrosion products.

The cathode element is then washed with water under pressure to remove the solution and is then electroplated with a 5 weight percent solution of Hunt Chemical Co. WAYPLEX® 1-hydroxyethane-1,1-disphosphonic acid. The electroplating is carried out first with the cathode element as an anode and then with the unit as a cathode. The element is then removed from the electroplating solution and a hydrogen evolution electrocatalyst is plated thereon and treated and thereafter the cathode is inserted in a slurry of asbestos and alternating chlorotrifluoroethylene-ethylene resin in cell liquor to deposit a resin-reinforced asbestos diaphragm thereon.

EXAMPLE 1

A resin-reinforced asbestos diaphragm was removed from a fingered iron mesh cathode by soaking in an aqueous solution of hydrochloric acid, ammonium hydroxide, and inhibitor.

The diaphragm had been applied to the cathode by codeposition of about 0.3 pounds per square foot of chrysotile asbestos and Allied Chemical Co. HALAR® alternating poly(ethylene-chlorotrifluoroethylene) resin from a slurry of the solids, i.e., resin and asbestos, in aqueous sodium hydroxide and sodium chloride. The cathode element with the deposited asbestos and resin was then heated to above about 450° C. for 4 hours to provide a 1/16 inch (1.5 mm) thick resin reinforced asbestos diaphragm.

An aqueous cleaning solution was prepared containing 6 weight percent ammonium bifluoride and 9 weight percent hydrochloric acid.

The cathode, with the resin-reinforced asbestos diaphragm thereon, was soaked in the aqueous cleaning solution for 4 hours at about 25° C. After 4 hours the cathode was removed from the cleaning solution and the remaining asbestos washed off easily.

EXAMPLE 2

One piece of asbestos impregnated mild steel wire mesh cathode screen was cleaned in an aqueous solution of hydrogen fluoride, hydrochloric acid, and corrosion inhibitor.

An asbestos impregnated steel wire mesh portion measuring 1 inch by 3 inches (2.5 cm by 7.6 cm) was cut from a diaphragm cell.

The cleaning solution was prepared by dissolving 24 grams of $NH_4F.HF$ in 200 milliliters of distilled water. Two hundred milliliters of a 20 percent aqueous solution of HCl was added to the dissolved $NH_4F.HF$ solution.

The cathode segment was immersed in the cleaning solution for 5 minutes, then removed, and the asbestos remnants removed by water spray. The cathode segments were then allowed to dry in air for 30 minutes and then placed in a 5 weight aqueous solution of Hunt Chemical Co. WAYPLEX® 1-hydroxyethane-1,1-diphosphonic acid. The cathode segment was rendered cathodic for 15 minutes and then rendered anodic for 20 minutes. The anodic electrode potential rose from 0.128 volt to 0.150 volt over a period of 15 minutes and then began to drop, at which time the cathode segment was removed from the solution, washed in water, dried in air, and placed in an electroless plating solution to deposit a catalytic surface thereon.

While the invention has been described with reference to specific embodiments and exemplifications thereof, the invention is not to be so limited except as in the claims appended hereto.

We claim:

1. A method of preparing an iron body for receipt of a catalytic coating comprising:

contacting the iron body with an aqueous cleaning solution comprising an iron oxidation inhibitor, hydrochloric acid, and a source of hydrofluoric acid; and thereafter maintaining the iron body anodic in an aqueous solution consisting essentially of water and a hydroxy acid until the electrode potential of the clean iron body has decreased by at least 0.01 volt.

2. The method of claim 1 wherein the aqueous hydroxy acid is 1-hydroxy-ethane-1,1-diphosphonic acid.

3. The method of claim 1 comprising maintaining the iron body cathodic in the aqueous solution for at least about 5 minutes and thereafter rendering the iron body anodic until the electrode potential of the iron body decreases by about 0.01 volt.

4. A method of treating a metal body for subsequent deposition of a catalytic material comprising maintaining the metal body anodic in an aqueous solution consisting essentially of water and a hydroxy acid until the electrode potential decreases by at least 0.01 volt.

5. The method of claim 4 comprising rendering the metal body cathodic in the aqueous solution and thereafter rendering the metal body anodic.

6. The method of claim 4 wherein the hydroxy acid is 1-hydroxy-ethane-1,1-diphosphonic acid.

* * * * *